United States Patent [19]

Kuwamoto et al.

[11] Patent Number: 4,637,885

[45] Date of Patent: Jan. 20, 1987

[54] METAL-WORKING OIL COMPOSITION

[75] Inventors: Hiroshi Kuwamoto, Fukuyama; Hiroyuki Nagamori; Takashi Mukai, both of Wakayama; Shuichi Iwado, Fukuyama, all of Japan

[73] Assignees: Kao Corporation; Nippon Kokan Kabushiki Kaisha, both of Tokyo, Japan

[21] Appl. No.: 786,359

[22] Filed: Oct. 11, 1985

Related U.S. Application Data

[63] Continuation of Ser. No. 615,945, May 31, 1984, abandoned.

[30] Foreign Application Priority Data

Jun. 10, 1983 [JP] Japan ..... 58-103627

[51] Int. Cl.[4] ..... C10M 137/04; C10M 137/08; C10M 137/16

[52] U.S. Cl. ..... 252/32.5; 252/34; 252/49.8; 252/565

[58] Field of Search ..... 252/32.5, 49.5, 34, 252/49.8, 565

[56] References Cited

U.S. PATENT DOCUMENTS

| | | | |
|---|---|---|---|
| 3,642,847 | 2/1972 | Otto | 252/32.5 |
| 3,779,928 | 12/1973 | Schlicht | 252/32.5 |
| 3,979,308 | 9/1976 | Mead | 252/32.5 |
| 4,130,494 | 12/1978 | Shaub | 252/32.5 |
| 4,260,499 | 4/1981 | Fein | 252/32.5 |
| 4,312,768 | 1/1982 | Nassry | 252/49.5 |

OTHER PUBLICATIONS

*Hackh's Chemical Dictionary,* 4th Ed., McGraw-Hill, (1969), p. 514.

*Primary Examiner*—Ferris H. Lander
*Attorney, Agent, or Firm*—Oblon, Fisher, Spivak, McClelland & Maier

[57] ABSTRACT

A metal-working oil composition comprises as essential components thereof (a) one or more lube-oil components selected from the group consisting of oils, fats, mineral oils and fatty acid esters; and (b) one or more compounds selected from the group consisting of acidic phosphoric acid salts of aliphatic, alicyclic and aromatic amines each of which has 4 to 22 carbon atoms and quaternary ammonium salts formed from aliphatic or aromatic amines, each of which has 4 to 22 carbon atoms, and acidic phosphoric acids; and (c) a non-ionic surfactant.

Incorporation of a specific amine compound together with a non-ionic surfactant permits, owing to the protective colloidal function of the compounds, stable dispersion of the lube-oil component as large droplets in water and hence the resulting dispersion enjoys good circulation stability and withstands severe machining conditions.

17 Claims, No Drawings

METAL-WORKING OIL COMPOSITION

This application is a continuation of application Ser. No. 615,945, filed May 31, 1984 and now abandoned.

BACKGROUND OF THE INVENTION (i) Field of the Invention:

This invention relates to a novel metal-working oil composition, and more specifically to a metal-working oil composition containing a lube-oil component, a specific amine compound and a non-ionic surfactant.

(ii) Description of the Prior Art:

Conventional metal-working oils which have generally been used are each obtained by adding lube-oil additives such as an oilness agent, extreme-pressure additive, rust preventive and/or antioxidant to a lube-oil component such as an oil, fat, mineral oil or fatty acid ester and then converting the resultant mixture into an o/w-type emulsion by means of an emulsifier. They are fed to metal-working parts, usually with concentrations of 1 to 20%. In the case of rolling a metal for example, it has however been attempted to increase the rolling speed so as to achieve mass production, relying upon rapid advancement in rolling facilities and technology which has been achieved in recent years. Reflecting such an attempt, requirements for rolling oil such as lubricity, circulation stability, working efficiency and treatment readiness of waste water have become progressively severer. There is thus a strong standing desire for the development of a rolling oil which can satisfactorily meet such requirements. However, conventional rolling oils which make use of emulsifiers are accompanied by various drawbacks and are hence unable to fulfill such requirements. In the case of a conventional rolling oil relying upon an emulsifier, the rolling lubricity was controlled by changing the type and amount of the emulsifier in such a way that the amount of the oil which was to adhere on rollers and each workpiece, in other words, the plate-out quantity was either increased or decreased. In such an emulsifier-containing rolling oil as described above, the plate-out quantity and the circulation stability of the emulsion showed mutually-contradictory tendency, namely, the plate-out quantity to each workpiece is decreased and the lubricity is thus rendered insufficient if the stability of the emulsion is enhanced. If one tried to increase the plate-out quantity, the emulsion became unstable and developed various problems when circulated for its reuse. Accordingly, conventional rolling oils making use of emulsifiers were accompanied by such drawbacks as mentioned above. Furthermore, still further improvements are also desired to the lubricity and working efficiency of other metal-working oils such as press-working oils and cutting oils.

The present inventors improved on the aforementioned drawbacks accompanying conventional emulsion-type metal working oils. As a result, it was succeeded to improve the by using a lube-oil component, which contained an oil, fat or wax having a melting point of 20° to 100° C., in combination with a specific hydrophilic dispersant (a water-soluble, anionic, polymer compound) in such a way that the lube-oil component was stably suspended and dispersed in a solid form in water at a temperature below the melting point but the resultant dispersion became unstable when fed to each working part, i.e., at a temperature above he melting point. A patent application has been already filed on the above finding (see, Japanese Patent Application Laid-open No. 147593/1980).

SUMMARY OF THE INVENTION

The present inventors have now succeeded in further improving over the prior art by obtaining a metal-working oil composition which may be successfully employed for working metals under high shear conditions which are expected to be encountered upon actual applications under high-speed and high-pressure conditions. The present composition also permits metal machining under severe cutting conditions, and facilitate process control providing excellent liquid circulation stability.

The present inventors have found that (1) the combined use of a salt of a specific amine compound and a non-ionic surfactant permits, owing to the protective colloidal function of these compounds, stable dispersion of the lube-oil component as large droplets in water and hence the resulting dispersion enjoys good circulation stability; (2) when supplied to a working part and brought into contact with a metallic workpiece, oil droplets having large diameters form a thick and strong lubricating film over the workpiece; (3) while circulated and reused for an extended period of time, large diameters can be stably maintained against shear forces produced by a stirrer in a tank and by a feed and circulation pump; (4) and the additional incorporation use of an organic or inorganic acidic phosphoric acid, which has conventionally been known as a compound having extreme-pressure effects, forms a lubricating film on the metal workpiece and hence achieve still higher lubricity.

Accordingly, this invention provides a metal-working oil composition comprising as essential components thereof:

(a) one or more lube-oil components selected from the group consisting of oils and fats, mineral oils and fatty acid esters;

(b) one ore more compounds selected from the group consisting of acidic phosphoric acid salts of aliphatic, alicyclic and aromatic amines each of which has 4 to 22 carbon atoms and quaternary ammonium salts formed from aliphatic or aromatic amines, each of which has 4 to 22 carbon atoms, and acidic phosphoric acids; and (c) a non-ionic surfactant.

DETAILED DESCRIPTION OF THE INVENTION AND PREFERRED EMBODIMENTS

As the lub-oil component which is the component (a) of the metal-working oil composition according to this invention, may for example be mentioned a mineral oil such as spindle oil, machine oil, turbine oil or cylinder oil, an animal or vegetable oil or fat such as whale oil, beef tallow, hog fat, rape oil, castor oil, rice bran oil, palm kernel oil or coconut oil, or an ester between a fatty acid obtained from beef tallow, coconut oil, palm oil, castor oil or the like and an aliphatic primary alcohol containing 1 to 22 carbon atoms, ethylene glycol, neopentyl alcohol, pentaerythritol or the like. These components may be used singly. Alternatively, two of these components may also be used in combination.

On the other hand, the aliphatic, alicyclic and aromatic amines, which are components (b) and have 4 to 22 carbon atoms individually, (hereinafter called "amine compounds" for the sake of brevity) are all known compounds. The following compounds may be mentioned as their examples.

(1) Alkylamines containing 4 to 22 carbon atoms individually, for example, monoamines such as butylamine,, hexylamine, decylamine, laurylamine and oleylamine, and diamines such as dibutylamine, propyldecylamine and dipalmitylamine; and their derivatives;

(2) Polyalkylenepolyamines, for example, ethylenediamine, diethylenetriamine, triethylenetetramine, tetraethylenepentamine, pentaethylenehexamine, etc.; and their derivatives;

(3) Alicyclic amines having 3 to 6 carbon atoms individually, for example, cyclohexylamine; and their derivatives;

(4) Diamines each of which contains an alkyl group having 4 to 22 carbon atoms, for example, N-octylethylenediamine, N-oleylethylenediamine, N-laurylpropylenediamine, N-stearylpropylenediamine and N-oleylbutylenediamine; and their derivatives;

(5) Amines each of which contains at least one phenyl group, for example, monoamines such as benzylamine and butylbenzylamine; diamines or triamines each of which contains an alkyl group having 1 to 22 carbon atoms and a phenyl group, for example, secondary amines such as benzylmethylamine, dibenzylamine benzylethylamine and benzyldecylamine; and triamines such as dimethylbenzyamine; as well as their derivatives;

(6) Tertiary amines each of which contains an alkyl group having 1 to 22 carbon atoms, for example, lauryldimethylamine, propyldimethyl amine and stearyldimethylamine; and their derivatives;

(7) Imidazolines each of which contains an alkyl group having 1 to 22 carbon atoms; and their derivatives; and (8) Picolines each of which contains an alkyl group having 1 to 22 carbon atoms; and their derivatives.

As counter ions usable to prepare the acidic phosphoric acid salts or quaternary ammonium salts of these amine compounds (hereinafter called "salts of amine compounds"), may be mentioned to following phosphoric acids (i) to (v):

(i) phosphoric acid and phosphorous acid as well as thio compounds and ester compounds thereof;

(ii) Mono- and di-phosphoric acid esters containing respectively alkyl, alkylaryl and aryl groups which contain individually at least one hydroxyl group as well as thio compounds thereof;

(iii) mono- or di-phosphonic acids which contain respectively alkyl groups containing 1 to 8 carbon atoms, alkylaryl groups and aryl group and thio compounds thereof, as well as derivatives thereof;

(iv) mono- or di-phosphinic acids which contain respectively alkyl groups having 1 to 8 carbon atoms, alkylaryl groups and aryl group and thio compounds thereof, as well as derivatives thereof; and (v) mono-, di- and tri-phosphonic acids containing one or more nitrogen atoms.

The following compounds may be mentioned as specific examples of the phosphoric acid compounds. As phosphoric acid compounds (i), may be mentioned by way of example phosphoric acid, phosphorous acid, mono- or di-phosphoric acid esters between aliphatic alcohols containing 1 to 8 carbon atoms, alicyclic alcohols or aromatic alcohols and phosphoric acid as well as thio compounds of the mono- or di-phosphoric acid esters, and esters between the above alcohols and phosphorous acid and thio compounds of the esters. As an exemplary phosphoric acid compound (ii), may be mentioned 2-hydroxydipropyl phosphate. Illustrative of the phosphoric acid compounds (iii) may include phosphonic acids represented by the general formula:

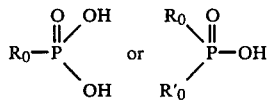

wherein $R_0$ and $R_0'$ mean individually an alkyl group having 1 to 8 carbon atoms, alkylaryl group or aryl group, for example, methylphosphonic acid containing 1 carbon atom, dimethylphosphonic acid to n-octylphosphonic acid containing 8 carbon atoms, di-n-octylphosphonic acid, 2-ethylhexylphosphonic acid, di-2-ethylhexylphosphonic acid, benzylphosphonic acid, dibenzylphosphonic acid, phenylphosphonic acid, diphenylphosphonic acid and hydroxyethanediphosphonic acid, as well as their thiophosphonic acids. Hydroxyethanediphosphonic compound is a compound represented by the following formula:

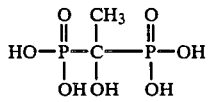

As exemplary phosphoric acid compounds (iv), may be mentioned phosphinic acids represented by the general formula:

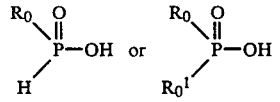

wherein $R_0$ and $R_0'$ have the same meanings as defined above, for example, methylphosphinic acid containing 1 carbon atom, dimethylphosphinic acid to n-octylphosphinic acid containing 8 carbon atoms, di-n-octylphosphinic acid, 2-ethylhexylphosphinic acid, di-2-ethylhexylphosphinic acid, benzylphosphinic acid, dibenzylphosphinic acid, as well as their thiophosphinic acids. As phosphoric acid compounds (v), may for example be mentioned hexamethylphosphoric mono-(or di-)amide and nitrilotrismethylenephosphonic acid. Nitrilotrismethylenephosphonic acid is a compound represented by the following formula:

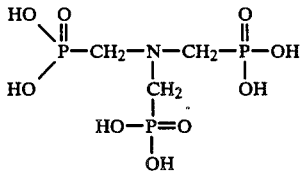

There is no particular limitation vested on the non-ionic surfactant which is the component (c). The following surfactants may however be mentioned as preferable non-ionic surfactants:

(1) Non-ionic surfactants having HLBs within the range of 3.0 to 20.0, for example, (a) Polyoxyethylenealkyl and alkylaryl ethers, each having 6 to 22 carbon atoms;

(b) Polyoxyethylenepolyoxypropylenealkyl and alkylaryl ethers, each having 6 to 22 carbon atoms;

(c) The sorbitan and polyoxyethylenesorbitan esters of fatty acids having 8 to 18 carbon atoms;

(d) The glycerin monoesters and polyoxyethyleneglycerin esters of fatty acids each of which has 8 to 18 carbon atoms; and (e) Polyoxyethylenebenzyl phenyl ether, polyoxyethylenestyrenated phenyl ether, and so on;

(2) Oxyethylene-oxypropylene block polymers in each of which the weight percentage of ethylene oxide present in the whole molecules is 8 to 85%;

(3) Addition products between ethylene diamine and propylene and ethylene oxides, in each of which the weight percentage of ethylene oxide present in the whole molecules is 8 to 85%;

(4) Addition product between alkylamines and ethylene oxide, in which each of he alkylamines contains 6 to 18 carbon atoms (the number of added moles: 1 to 50); and (5) Polyethyleneglycol esters of fatty acids each of which contains 8 to 18 carbon atoms.

The metal-working oil composition of this invention may be prepared by mixing the above components. It is however preferred to limit their proportions within the following ranges, all based on the whole composition: the lube-oil component (a): 99.9 to 50 wt% (hereinafter referred to merely as %), especially 99.9 to 70%, the amine compound salt (b) and non-ionic surfactant (c): 0.1 to 20% or preferably, 0.1 to 10% in total based on the whole composition, in which the component (c) may preferably be 0.2 to 5.0% or notably 0.5 to 3.0%.

To the metal-working oil composition of this invention, it is feasible to add, besides the above-mentioned components, a variety of known additives as needed, for example, a surfactant, rust preventive, oilness agent, extreme-pressure additive, antioxidant and the like.

The above-described various additives may, whenever necessary, be added respectively in amounts of 0 to 5%, 0 to 2%, 0 to 20%, 0 to 3% and 0 to 5%.

As illustrative rust preventives, may be mentioned fatty acids such as alkenylsuccinic acids and their derivatives and oleic acid, esters such as sorbitan monooleate, and amines, and so on. Exemplary oilness agents may include higher fatty acids such as oleic acid and stearic acid, fatty acid esters which are derivatives of such fatty acids, dibasic acids such as dimeric acid and the like. On the other hand, phosphorous compounds such as tricresylphosphates and organometallic compounds such as zinc dialkyldithiophosphates may be mentioned as exemplary extreme-pressure additives. As illustrative antioxidants, may be mentioned phenolic compounds such as 2,4-di-t-butyl-p-cresol, aromatic amines such as phenyl-alpha-naphthylamine, etc.

The metal-working oil composition of this invention may be employed by either simply mixing the above-described various components upon actually using the metal-working oil composition or preparing it as a thick solution having a water content of up to about 80% in advance and then diluting same with water upon actually using the metal-working oil composition.

The thus-obtained metal working oil composition according to this invention can provide a metal-working oil which can afford relatively large droplets with a stable size distribution under such stirring conditions as having a high shear force, can exhibit high-lubricative property and shows small quality changes along the passage of time and excellent circulation stability. Besides, the above metal-working oil composition of this invention has such merits as will be described next. The amine compound salt useful in the practice of this invention has by itself such capacity as being rapidly adsorbed on liquid or solid particles to make the liquid or solid particles hydrophilic but has by itself little capacity of lowering the interfacial tension between water and oil so as to emulsify their mixture. Therefore, the lube-oil component is not emulsified to any significant extent. Compared with conventional metal-working oils making use of emulsifiers, the metal-working oil composition of this invention is thus advantageous in that it develops the so-called holding-in phenomenon, that is to absorb fouled oil mixed in during an actual rolling operation and foreign matter such as metal powder and the like, only to a lowered extent and it always retain high lubricating characteristics as a clean metal-working oil. Owing to the function of the above-described amine compound salt, the metal-working oil composition of this invention has rendered the working environment cleaner and the treatment of waste water easier. Therefore, the metal-working oil composition of this invention has such an excellent feature that it can materialize a clean working environment which has not been achieved by any conventional rolling oils making use of emulsifiers.

Although the mechanism of action achieved owing to the use of the amine compound salt and the non-ionic surfactant in accordance with this invention has not been fully elucidated, they seem to act probably in the following manner. Namely, the phosphoric acid salt of the amine compound and non-ionic surfactant, which have been dissolved uniformly in a water layer, adsorbs droplets of the lube-oil component, which droplets have been formed by mechanical shear forces, before the droplets begin to agglomerate. The polyetherpolyol compound then converts oil droplets into larger droplets in accordance with a sort of coagulation action. The resultant larger droplets are dispersed stably in water by the steric and electric, protective-colloidal action of the polyetherpolyol compound. This feature is different from that brought about by the water-soluble, anionic, polymer compound in Japanese Patent Application Laid-open No. 147593/1980, because the water-soluble, anionic, polymer compound has a weak coagulation action for oil droplets and the lube-oil component is stabilized still in the form of fine droplets owing to the protective colloidal action and the thus-divided fine oil droplets cannot be formed back into larger droplets.

The present invention will hereinafter be described with reference to Examples.

The following metal-working oil compositions were used in the Examples. In addition, the following compounds were used respectively as salts of amine compounds, non-ionic surfactants, an antioxidant and a extreme-pressure additive:

Salts of amine compounds:

(1) The phosphoric acid salt of laurylamine;

(2) The ethylphophonic acid salt of coconutdimethylamine;

(3) The di-n-butylhydrogenphosphite salt of diethylenetriamine;

(4) The propylphosphinic acid salts of N-(beef tallow-)alkylethylenediamines;

(5) The quaternary ammonium salt of benzyl-dimethylamine by thiophosphoric acid;

(6) The di-(2-ethylhexyl)phosphate salts of N-coconutalkylpropylenediamines; and (7) The diethylphosphate salt of N-coconutimidazoline.

Non-ionic surfactants:

(1) Polyoxyethylenenonyl phenyl ether (HLB=7.8);

(2) Sorbitan monooleate/polyoxyethylenesorbitan monolaurate (HLB=16.7)=2/1 (by weight ratio);

(3) Oxyethylene-oxypropylene block polymer (the weight percent of ethylene oxide in the whole molecules is 20% and the block polymer has a molecular weight of about 2250); and (4) A non-ionic surfactant obtained by adding 5 moles of ethylene oxide to laurgylamine.

Antioxidant:

2,4-di-t-butyl-p-cresol.,

Extreme-pressureadditive:

Triphenylphosphite.

TABLE 1

(%)

| Invention Product | Lube-Oil Component: Beef Tallow | Fatty Acids Derived from Beef Tallow | Salt of Amine Compound | Extreme-Pressure Additive | Non-ionic Surfactant | Anti-oxidant |
|---|---|---|---|---|---|---|
| No. 1 | 95 | 2 | (1) 1 | to | (1) 1 | 1 |
| No. 2 | 95.5 | 2 | (2) 0.5 | — | (2) 1 | 1 |
| No. 3 | 93 | 2 | (3) 3 | — | (3) 1 | 1 |
| No. 4 | 91 | 2 | (4) 5 | — | (4) 1 | 1 |
| No. 5 | 94.95 | 2 | (5) 0.05 | 1 | (1) 1 | 1 |
| No. 6 | 93 | 2 | (6) 2 | 1 | (2) 1 | 1 |
| No. 7 | 93 | 2 | (7) 2 | 1 | (3) 1 | 1 |
| No. 8 | 93 | 2 | (1) 1<br>(7) 1 | 1 | (4) 1 | 1 |

(%)

| Invention Product | Lube-Oil Component: Mineral Oil (Spindle Oil) | Octyl Stearate | Oleic Acid | Salt of Amine Compound | Extreme-Pressure Additive | Non-ionic Surfactant | Anti-oxidant |
|---|---|---|---|---|---|---|---|
| No. 9 | 72.95 | 20 | 5 | (1) 0.05 | — | (1) 1 | 1 |
| No. 10 | 72 | 20 | 5 | (2) 1 | — | (2) 1 | 1 |
| No. 11 | 68 | 20 | 5 | (3) 5 | — | (3) 1 | 1 |
| No. 12 | 71 | 20 | 5 | (4) 2 | — | (4) 1 | 1 |
| No. 13 | 71.5 | 20 | 5 | (5) 0.5 | 1 | (1) 1 | 1 |
| No. 14 | 71.7 | 20 | 5 | (6) 0.3 | 1 | (2) 1 | 1 |
| No. 15 | 70 | 20 | 5 | (7) 2 | 1 | (3) 1 | 1 |
| No. 16 | 69 | 20 | 5 | (2) 2<br>(5) 1 | 1 | (4) 1 | 1 |

(%)

| Invention Product | Lube-Oil Component: Mineral Oil (Cylinder Oil) | Penta-erythritol Tetraoleate | Salt of Amine Compound | Extreme-Pressure Additive | Non-ionic Surfactant | Anti-oxidant |
|---|---|---|---|---|---|---|
| No. 17 | 76 | 20 | (1) 2 | — | (1) 1 | 1 |
| No. 18 | 73 | 20 | (2) 5 | — | (2) 1 | 1 |
| No. 19 | 77.5 | 20 | (3) 0.5 | — | (3) 1 | 1 |
| No. 20 | 76 | 20 | (4) 2 | — | (4) 1 | 1 |
| No. 21 | 76 | 20 | (5) 1 | 1 | (1) 1 | 1 |
| No. 22 | 75 | 20 | (6) 2<br>(3) 1 | 1 | (2) 1 | 1 |
| No. 23 | 76.95 | 20 | (7) 0.05 | 1 | (3) 1 | 1 |
| No. 24 | 75 | 20 | (6) 2 | 1 | (4) 1 | 1 |

Furthermore, the following metal-working oil compositions were used as comparative products. Comparative product No. 1:

| | |
|---|---|
| Comparative product No. 1: | |
| Lube-oil component: | |
| Beef tallow | 95% |
| Fatty acids derived from beef tallow | 2 |
| Non-ionic surfactant(1) | 2 |
| Antioxidant | 1 |
| Comparative product No. 2: | |

-continued

| | |
|---|---|
| Lube-oil component: | |
| Beef tallow | 94% |
| Fatty acids derived from beef tallow | 2 |
| Extreme-pressure additive | 1 |
| Non-ionic surfactant(1) | 2 |
| Antioxidant | 1 |
| Comparative product No. 3: | |
| Lube-oil component; | |
| Mineral oil (cylinder oil) | 77% |
| Pentaerythritol tetraoleate | 20 |
| Non-ionic surfactant(2) | 2 |
| Antioxidant | 1 |
| Comparative product No. 4: | |
| Lube-oil component: | |
| Mineral oil (cylinder oil) | 76% |
| Pentaerythritol tetraoleate | 20 |
| Extreme-pressure additive | 1 |
| Non-ionic surfactant(2) | 2 |
| Antioxidant | 1 |
| Comparative product No. 5: | |
| Lube-oil component: | |
| Mineral oil (spindle oil) | 72% |
| Octyl stearate | 20 |
| Oleic acid | 5 |
| Non-ionic surfactant(3) | 2 |
| Antioxidant | 1 |
| Comparative product No. 6: | |
| Lube-oil component: | |

-continued

| | |
|---|---|
| Mineral oil (spindle oil) | 71% |
| Octyl stearate | 20 |
| Oleic acid | 5 |
| Extreme-pressure additive | 1 |
| Non-ionic surfactant(3) | 2 |
| Antioxidant | 1 |

EXAMPLE 1

Seizure-Resistant Loading Test

(Falex Testing Method)

The measurement of seizure-resistant loads was carried out in accordance with ASTM Standard D-3233 Pressure Resistant Loading test (Falex Test). The preparation of each test sample was carried out by diluting each metal-working oil composition with water to a concentration of 3% and then mixing the resultant mixture at 10,000 rpm in a homogenizer. The coating of each test sample was effected by applying the above-mixed solution to a rotary pin, which was disposed centrally in a fixed block, at a spray rate of 50 ml/min (a pressure of 0.5 kg/cm$^2$) and a dispersion temperature of 50° C. by means of a gear pump.

Results are given in Table 2.

TABLE 2

| Metal-working Oil composition | Seizure-resistant Load (lbs.) |
|---|---|
| Invention Product No. | |
| 1 | 1500 |
| 2 | 1750 |
| 3 | 1500 |
| 4 | 1500 |
| 5 | 1250 |
| 6 | 1750 |
| 7 | 1750 |
| 8 | 1750 |
| 9 | 1000 |
| 10 | 1500 |
| 11 | 1500 |
| 12 | 1500 |
| 13 | 1500 |
| 14 | 1750 |
| 15 | 1500 |
| 16 | 1500 |
| 17 | 1250 |
| 18 | 1500 |
| 19 | 1250 |
| 20 | 1250 |
| 21 | 1250 |
| 22 | 1500 |
| 23 | 1000 |
| 24 | 1500 |
| Comparative Product No. | |
| 1 | 1000 |
| 2 | 1250 |
| 3 | 1000 |
| 4 | 1250 |
| 5 | 750 |
| 6 | 1000 |

EXAMPLE 2

Seizure Loading Test

(Soda's four-balls Testing Method)

The measurement of seizure loads was conducted in accordance with Japanese Self-Defence Force Provisional Standard NDS XXK 2740, Oil Film Strength Testing Method (Soda's Four-Ball Testing Method). The preparation of each test sample was carried out by diluting each metal-working oil composition with water to a concentration of 3% and then mixing the resultant mixture at 10,000 rpm in a homogenizer. The coating of each test sample was effected by applying the above-mixed solution upwardly through a gap formed centrally among three points of contact of three testing steel balls, which were fixed by a ball retainer, to a rotary steel ball, which assumed a position above the three balls, at a spray rate of 0.5 liter/min. (a pressure of 0.5 kg/cm$^2$) and a sample solution temperature of 50° C. by means of a gear pump.

Results are summarized in Table 3.

TABLE 3

| Metal-working Oil Composition | Seizing Load (Kg/cm$^2$) |
|---|---|
| Invention Product No. | |
| 1 | 10.5 |
| 2 | 10.0 |
| 3 | 11.0 |
| 4 | 10.5 |
| 5 | 7.0 |
| 6 | 12.0 |
| 7 | 11.0 |
| 8 | 10.5 |
| 9 | 6.0 |
| 10 | 8.0 |
| 11 | 8.5 |
| 12 | 8.5 |
| 13 | 8.5 |
| 14 | 8.5 |
| 15 | 9.0 |
| 16 | 8.5 |
| 17 | 8.0 |
| 18 | 8.5 |
| 19 | 8.5 |
| 20 | 8.5 |
| 21 | 8.0 |
| 22 | 8.5 |
| 23 | 5.0 |
| 24 | 8.5 |
| Comparative Product No. | |
| 1 | 7.5 |
| 2 | 8.0 |
| 3 | 6.0 |
| 4 | 6.0 |
| 5 | 5.0 |
| 6 | 5.5 |

EXAMPLE 3

Test on Readiness of Treatment of Waste Water

Each test solution (1 liter) prepared in the same manner as in Example 2 was added with 3 g of aluminum sulfate. The resulting mixture was stirred for 2 minutes, followed by an addition of $Ca(OH)_2$ to adjust its pH to 7.0. The thus-prepared mixture was stirred for further 10 minutes. After allowing the resultant mixture to stand for 30 minutes, the supernatant was collected to measure its COD (in accordance with the $KMnO_4$ method).

Results are shown in Table 4.

TABLE 4

| Metal-working Oil Composition | COD (ppm) |
|---|---|
| Invention Product No. | |
| 1 | 930 |
| 2 | 880 |
| 3 | 850 |
| 4 | 1200 |
| 5 | 2180 |
| 6 | 920 |
| 7 | 1490 |
| 8 | 760 |
| 9 | 2810 |

TABLE 4-continued

| Metal-working Oil Composition | COD (ppm) |
|---|---|
| 10 | 1350 |
| 11 | 810 |
| 12 | 890 |
| 13 | 1260 |
| 14 | 750 |
| 15 | 670 |
| 16 | 1050 |
| 17 | 820 |
| 18 | 880 |
| 19 | 610 |
| 20 | 760 |
| 21 | 940 |
| 22 | 1310 |
| 23 | 2220 |
| 24 | 880 |
| Comparative Product No. | |
| 1 | 2750 |
| 2 | 2550 |
| 3 | 2320 |
| 4 | 1980 |
| 5 | 2500 |
| 6 | 2810 |

EXAMPLE 4

Measurement of Droplet Sizes

Each metal-working oil composition was diluted with water to a concentration of 3% and was then heated to a temperature of 60° C. It was thereafter agitated at 10,000 rpm for 60 minutes in a homogenizer to prepare a test sample. The measurement of droplet sizes of the test sample was carried out in accordance with the Coleter's counter method, using apertures of 200 micrometers.

Results are given in Table 5.

TABLE 5

| Metal-working Oil Composition | Droplet Size |
|---|---|
| Invention Product No. | |
| 1 | 12.5 |
| 2 | 12.1 |
| 3 | 13.2 |
| 4 | 10.5 |
| 5 | 7.2 |
| 6 | 10.3 |
| 7 | 10.5 |
| 8 | 12.1 |
| 9 | 7.3 |
| 10 | 10.5 |
| 11 | 12.1 |
| 12 | 10.3 |
| 13 | 9.5 |
| 14 | 10.5 |
| 15 | 10.1 |
| 16 | 12.2 |
| 17 | 10.5 |
| 18 | 11.8 |
| 19 | 11.5 |
| 20 | 10.7 |
| 21 | 12.2 |
| 22 | 12.5 |
| 23 | 7.0 |
| 24 | 13.2 |
| Comparative Product No. | |
| 1 | 5.0 |
| 2 | 6.2 |
| 3 | 7.3 |
| 4 | 7.2 |
| 5 | 7.8 |
| 6 | 7.5 |

What is claimed is:

1. A metal-working oil composition consisting essentially of:

(a) 99–50 wt.% of one or more lube-oil components selected from the group consisting of oils, fats, mineral oils and fatty acid esters;

(b) 0.1–20 wt.% of one or more compounds selelcted from the group consisting of salts of:

aliphatic, alicyclic and aromatic amines having 4 to 22 carbon atoms and quaternary ammonium salts formed from aliphatic or aromatic amines having 4 to 22 carbon atoms; and acidic phosphoric acids selected from the group consisting of:

(i) phosphorous acid, thio compounds thereof, ester compounds thereof and thio compounds of phosphoric acid;

(ii) mono- and di-phosphoric acid esters containing an aryl group and at least one hydroxyl group, thio compounds thereof, and thio compounds of mono- and di-phosphoric acid esters containing an alkyl or alkylaryl group and at least one hydroxyl group;

(iii) mono- or di-phosphonic acids containing a ($C_1$–$C_8$) alkyl group, an alkylaryl or aryl group, and thio compounds thereof;

(iv) mono- or di-phosphinic acids containing a ($C_1$–$C_8$) alkyl group, an alkylaryl or aryl group, and thio compounds thereof;

(v) mono-, di- or tri-phosphonic acids containing one or more nitrogen atoms;

(vi) phosphonous acids containing a ($C_1$–$C_8$) alkyl group, an alkylaryl or aryl group, and thio compounds thereof; and (vii) phosphinous acids containing a ($C_1$–$C_8$) alkyl group; and (c) 0.2–5.0 wt.% of a non-ionic surfactant.

2. The metal-working oil composition according to claim 1, wherein a counter ion capable of forming the acidic phosphoric acid salt or quaternary ammonium salt is an acidic phosphoric acid selected from the group consisting of the following acidic phosphoric acids (i) to (v):

(i) phosphoric acid, phosphorous acid, or thio and ester compounds of these acids;

(ii) mono- or di-phosphoric acid esters containing individually an alkyl, alkylaryl or aryl group and at least one hydroxyl group, or thio compounds thereof;

(iii) mono- or di-phosphonic acids containing individually an alkyl group having 1 to 8 carbon atoms or an alkylaryl or aryl group, or thio compounds or derivatives thereof;

(iv) mono- or di-phosphinic acids containing individually an alkyl group having 1 to 8 carbon atoms or an alkylaryl or aryl group, or thio compounds or derivatives thereof; or (v) mono-, di- or tri-phosphonic acids containing individually one or more nitrogen atoms.

3. The metal-working oil composition according to claim 1, wherein the sum of the components (b) and (c) amounts to 0.1 to 20 wt.% of the whole composition.

4. The composition of claim 1, wherein component (a) is selected from the group consisting of spindle oil, machine oil, turbine oil, cylinder oil, whale oil, beef tallow, hog fat, rape oil, castor oil, rice bran oil, palm kernel oil, coconut oil, esters of fatty acids obtained from beef tallow, coconut oil, palm oil, or castor oil with $C_1$–$C_2$ aliphatic primary alcohols and mixtures thereof.

5. The composition of claim 1, wherein the aliphatic amines of component (b) are selected from the group consisting of butylamine, hexylamine, decylamine, laurylamine, oleylamine, dibutylamine, propyldecylamine, dipalmitylamine, ethylenediamine, diethylenetriamine, triethylenetetramine, tetraethylenepentamine, pentaethylenehexamine, N-octylethylenediamine, N-oleylethylenediamine, N-laurylpropylenediamine, N-stearylpropylenediamine, N-oleylbutylenediamine, lauryldimethylamine, propyldimethylamine and stearyldimethylamine.

6. The composition of claim 1, wherein the alicyclic amines of (b) are selected from the group consisting of $C_3$–$C_8$ cycloalkylamines.

7. The composition of claim 1, wherein the aromatic amines of (b) are selected from the group consisting of benzylamine, butylbenzylamine, benzylmethylamine, dibenzylamine, benzylethylamine, benzyldecylamine, dimethylbenzylamine, ($C_1$–$C_{22}$) imidazolines, and picolines substituted by ($C_1$–$C_{22}$) alkyl.

8. The composition of claim 1, wherein component (i) is selected from the group consisting of phosphorous acid, the mono- or di-phosphoric acid esters of aromatic alcohols and phosphoric acid, thio compounds of said mono- or di-phosphoric acid esters, ($C_1$–$C_8$) aliphatic alcohols, alicyclic alcohols or aromatic alcohols esters of said phosphorous acid, and thio compounds thereof.

9. The composition of claim 1, wherein: (ii) is hydroxydipropyl phosphate.

10. The composition of claim 1, wherein: (iii) is selected from the group consisting of phosphonic acids of the formula:

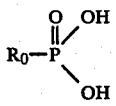

wherein $R_0$ and $R'_0$ are ($C_1$–$C_8$) alkyl, alkylaryl or aryl.

11. The composition of claim 1, wherein component (iii) is selected from the group consisting of methylphosphonic acid, n-octylphosphonic acid, 2-ethylhexylphosphonic acid, benzylphosphonic acid, phenylphosphonic acid and thiophosphonic acids.

12. The composition of claim 1, wherein component (iv) is selected from the group consisting of phosphinic acids of the formula:

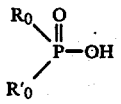

wherein $R_0$ and $R'_0$ have the same meaning as defined above.

13. The composition of claim 12, wherein component (iv) is selected from the group consisting of methylphosphinic acid, dimethylphosphinic acid, n-octylphosphinic acid, di-n-octylphosphinic acid, 2-ethylhexylphosphinic acid, di-2-ethylhexylphosphinic acid, benzylphosphinic acid, dibenzylphosphinic acid, and their thiophosphinic acid derivatives.

14. The composition of claim 1, wherein component (v) is selected from the group consisting of hexamethylphosphoric mono-(or di-)amine and nitrolotrismethylenephosphonic acid.

15. The composition of claim 1, wherein component (c) is selected from the group consisting of:

(1) non-ionic surfactants having HLBs within the range of 3.0 to 20.0 selected from the group consisting of:
  (a) polyoxyethylenealkyl or alkylaryl ethers having 6 to 22 carbon atoms;
  (b) polyoxyethylenepolyoxypropylenealkyl or alkylaryl ethers each having 6 to 22 carbon atoms;
  (c) sorbitan or polyoxyethylene sorbitan esters of fatty acids having 8 to 18 carbon atoms;
  (d) glycerin monoesters or polyoxyethyleneglycerin esters of fatty acids having 8 to 18 carbon atoms; and
  (e) polyoxyethylenebenzyl phenyl ether, or polyoxyethylenestyrenated phenyl ether, (2) oxyethylene-oxypropylene block polymers wherein the weight percentage of ethylene oxide present in the whole molecules is 8 to 85%;

(3) addition products between ethylene diamine and propylene and ethylene oxides, wherein the weight percentage of ethylene oxide present in the whole molecules is 8 to 85%;

(4) addition products between alkylamines and ethylene oxide, wherein the alkylamines contain 6 to 18 carbon atoms and the number of moles is 1 to 50; and (5) polyethyleneglycol esters of fatty acids having 8 to 18 carbon atoms.

16. The composition of claim 1, wherein component (vi) is selected from the group consisting of phosphonous acids of the formula:

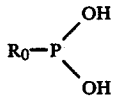

wherein $R_0$ have the same meaning as defined above.

17. The composition of claim 1, wherein component (vii) is selected from the group consisting of phosphinous acids of the formula:

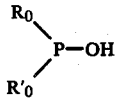

wherein $R_0$ and $R'_0$ have the same meanings as defined above.

* * * * *